United States Patent [19]

Massa

[11] 4,190,937

[45] Mar. 4, 1980

[54] METHOD OF MANUFACTURING ELECTROACOUSTIC TRANSDUCER ELEMENTS WHICH OPERATE IN THE VICINITY OF RESONANCE

[75] Inventor: Frank Massa, Cohasset, Mass.

[73] Assignee: The Stoneleigh Trust, Fred M. Dellorfano, Jr. & Donald P. Massa, Trustees, Choasset, Mass.

[21] Appl. No.: 135

[22] Filed: Jan. 2, 1979

[51] Int. Cl.[2] ..... H04R 31/00

[52] U.S. Cl. ..... 29/25.35; 29/593; 29/594

[58] Field of Search ..... 29/25.35, 593, 594; 324/80, 81

[56] References Cited

U.S. PATENT DOCUMENTS

| | | | |
|---|---|---|---|
| 4,050,126 | 9/1977 | Ikeno et al. | 29/593 X |
| 4,062,154 | 12/1977 | Huguenin et al. | 29/593 X |

*Primary Examiner*—Carl E. Hall

[57] ABSTRACT

An improved method of manufacturing electroacoustic transducers which employ vibratile transducer elements includes an automatic method of measuring the motional impedance vs. frequency characteristics of a plurality of transducer elements and an automatic method of segregating the transducer elements into separate groups which are selected in accordance with the similarities of the measured motional impedance characteristics of the elements. The separate groups of selected transducer elements are then processed by changing a mechanical dimension of the elements in each separate group by a different specified amount which adjusts the motional impedance vs. frequency characteristic of each separate group to the same specified desired value. The processed transducer elements are then assembled into complete transducers, thereby achieving improved uniformity in the performance characteristics of the transducers which is obtained at relatively low cost.

14 Claims, 4 Drawing Figures

METHOD OF MANUFACTURING ELECTROACOUSTIC TRANSDUCER ELEMENTS WHICH OPERATE IN THE VICINITY OF RESONANCE

This invention is concerned with the improvement in the method of manufacturing electroacoustic transducers and more particularly with the method of improving the efficiency of measuring, selecting, and adjusting the electromechanical parameters of vibratile transducer elements which are used in the construction of the electroacoustic transducers. It is well known that transducers operating in the ultrasonic frequency region are inefficient except when operating in the vicinity of resonance. It is also well known that the resonant frequency of a bi-laminar vibratile plate, such as the vibratile element 12 illustrated in U.S. Pat. No. 3,937,991, will vary significantly from element-to-element as a result of the normal variation in the thickness and width tolerances of the manufactured bi-laminar plate. When transducer applications require that the transducer transmitting sensitivity be uniform among all transducers at the specified operating frequency, it has been the custom to test the sensitivities of the completed transducers and to segregate the transducers into different frequency groups within which the resonant frequencies were sufficiently uniform to maintain the desired uniformity in the sensitivity of the transducers. The disadvantage of the procedure is that only a fraction of the transducers will fall into the specified frequency group and many of the transducers will fall into different frequency groups within which the sensitivities remain uniform. Thus the selection procedure does not help in the control of the parameters of the transducer element to permit the production to be controlled to yield a product to meet a single specified operating frequency requirement. One method for using transducers whose resonant frequency falls outside the specified operating frequency range is to use a tuning choke in combination with the transducer to increase the effective band width of the response characteristic. The disadvantages to this general practice is the added cost of the chokes and the lowering of the peak sensitivity of the transducer as a result of increasing the band width with the use of the tuning choke. The present invention overcomes both these objections and provides a low-cost method of accurately adjusting the resonant frequency of large quantities of transducer elements to a specified operating frequency.

The primary object of this invention is to improve the method of manufacturing an electroacoustic transducer and more particularly with the method of improving the efficiency of measuring, selecting, and adjusting the electromechanical parameters of the transducer elements used in the construction of the transducers.

Another object of this invention is to automatically measure the electromechanical characteristics of a plurality of electroacoustic elements and to automatically segregate the elements into separate groups having different specified values of the measured electromechanical parameters.

An additional object of this invention is to improve the method of manufacturing electroacoustic transducers employing vibratile transducer elements by segregating a plurality of transducer elements into separate groups having different motional impedance vs frequency characteristics and to selectively modify the mechanical dimensions of the transducer elements in each of the separate groups.

Still another object of this invention is to automatically measure the motional impedance vs frequency of a plurality of transducer elements and to automatically segregate the elements into different groups having different specified motional impedance characteristics.

A further object of this invention is to perform a uniformly similar specific production operation on a specified lot of transducer elements which have been selectively grouped in accordance with the similarity of their measured motional impedance characteristics.

Another object of the invention is to improve the uniformity of large numbers of mass-produced electroacoustic transducers by separating the transducer elements which are used in the construction of the electroacoustic transducers into a plurality of different groups in which each group contains elements having similar motional impedance vs frequency characteristics, and then performing a different specified uniform production operation on each of the different separated groups of elements for the purpose of modifying the motional impedance vs frequency characteristics of each separated group of elements, thereby reducing the variation among the response vs frequency characteristics of the assembled transducers utilizing the different modified groups of transducer elements.

Additional objects will become more apparent to those skilled in the art by the description of the invention which follows when taken with the accompanying drawings in which.

Figure 1:
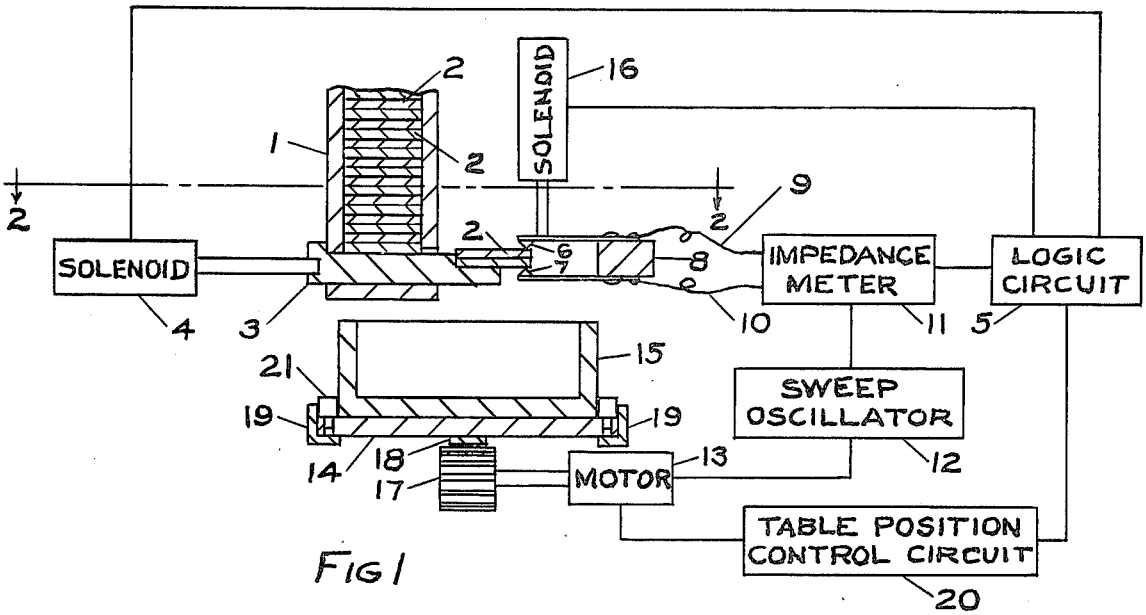
FIG. 1 is a vertical cross-sectional view of an illustrative example of one embodiment of this invention.
Figure 2:
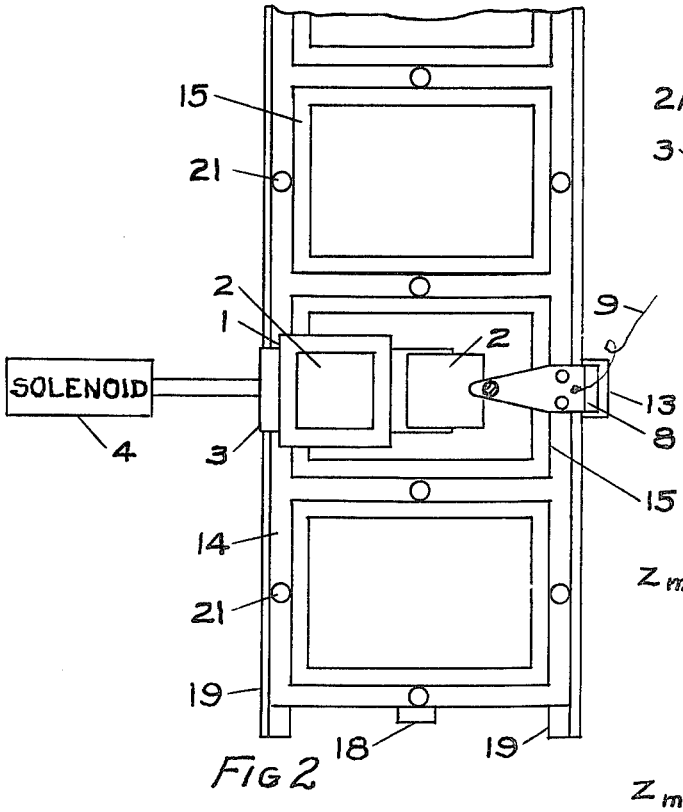
FIG. 2 is a plan view of the illustrative embodiment of this invention taken along the line 2—2 of FIG. 1.
Figure 3:
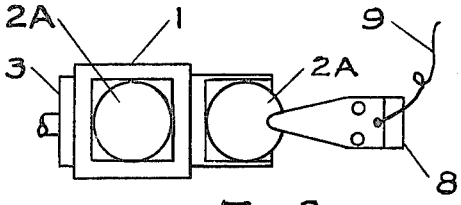
FIG. 3 is a partial view of the dispenser mechanism of FIG. 2 in which circular-shaped transducer elements are being automatically dispensed for motional impedance measurement as compared with the square-shaped elements which are being dispensed in the illustration of FIG. 2.

Referring more particularly to the figures, the reference character 1 illustrates a cartridge which holds a stack of vibratile transducer elements 2 which, for the purposes of illustration, are shown as square bi-laminar piezoelectric elements commonly known in the art as bimorphs. Each bimorph may consist of two bonded polarized ceramic plates, as is well known in the art, or each bimorph may consist of a single plate of polarized ceramic bonded to an inert plate of metal or other material. When A-C voltages are applied to the electrode surfaces of the ceramic element, flexural vibrations in the element will be established as is well known in the art. The bimorph elements may be of shapes other than square. For example, they may be circular in shape, as illustrated by 2A in FIG. 3. A shuttle plate 3 is operated on command by an electrical signal applied to the solenoid 4 from the logic circuit 5. Upon activation of the solenoid 4, the lower bimorph element 2 contained in the cartridge 1 is ejected, and the edge of the bimorph element is positioned between the electrical contact points 6 and 7 which are separated by the insulating block 8, as illustrated in FIG. 1. The shuttle plate 3 is retracted after positioning the bimorph element 2 between the contact terminals 6 and 7. Electrical conductors 9 and 10 connect the contact terminals 6 and 7 to the impedance meter 11.

Figure 4:
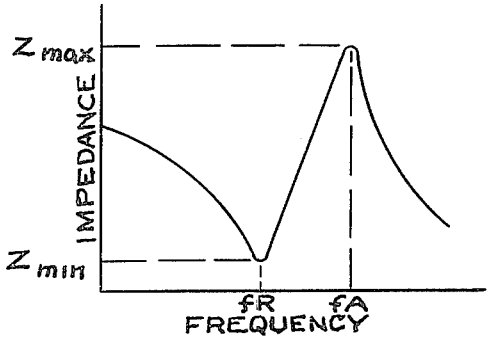
FIG. 4 is a typical motional impedance curve of a vibratile electromechanical transducer element showing the magnitude of the motional impedance of the element as a function of frequency in the vicinity of the resonance frequency of the element.

During the operation of the inventive automatic motional impedance test and segregation procedure, the sweep oscillator 12 sweeps the frequency of the signal applied across the ceramic element 2 in the conventional manner well known in the art between the frequency limits desired. The frequency sweep takes place after the shuttle plate 3 has been retracted so that the ceramic element 2 remains freely suspended without additional support while being held between the electrical contact points 6 and 7. During the sweep of the oscillator frequency, the motional impedance magnitude of the bimorph element will vary, as illustrated in FIG. 4. At the resonant frequency of the bimorph (fR), the magnitude of the motional impedance will be a minimum ($Z_{min}$). At the anti-resonant frequency (fA) of the bimorph, the magnitude of the motional impedance will be a maximum ($Z_{max}$). While the frequency is being swept, the logic circuit will recognize the magnitudes of the four variables illustrated in FIG. 4; namely, fR, $Z_{min}$, fA, and $Z_{max}$ for the particular element under test. The logic circuit is programmed to instruct the table position control circuit 20 to operate the motor 13 so that the table 14 is moved to bring the specified storage box 15 into position to receive the tested ceramic whose particular motional impedance characteristic is assigned to the specified storage box. The tested ceramic is allowed to drop into the presented specified storage box 15 by a signal transmitted by the logic circuit 5 to the solenoid 16 which causes the solenoid to lift the spring contact point 6 and thus release the tested element 2 causing it to drop into the selected storage box 15. The position of the box is directed by the rotation of the motor 13 which, in turn, operates the pinion gear 17 and rack gear 18 which moves the table 14 along the guide members 19, as required, to bring the position of the specified box 15 to receive the released ceramic element 2. The location of the boxes 15 on the table 14 are maintained by the cylindrical pins 21.

The operation of the sweep oscillator, the impedance meter, the logic circuit, and the table position control circuit are all well known to those skilled in the art of electronics and integrated circuits, and the detailed circuits for accomplishing the desired controls are not shown because they are not part of this invention. The invention resides in the novel combination of these well known control circuits to achieve the inventive automatic testing and selection of transducer elements in accordance with their common motional impedance characteristics. The invention additionally includes the execution of a different specified uniform production operation on each of the different separated groups of transducer elements for the purpose of adjusting the motional impedance vs frequency characteristics of each separate group of elements to the same specified value, thereby reducing the variation in the response vs frequency characteristics of the assembled transducers which use the separate modified groups of transducer elements.

A specific illustrative example of how the motional impedance measurement segregation procedure described in this invention has been successfully used by Applicant to achieve improved uniformity in electroacoustic performance characteristics among low-cost mass-produced quantities of transducers will be described.

Applicant developed the manufacturing procedure disclosed in this invention to solve the problem of improving the uniformity of performance characteristics among large quantities of manufactured electroacoustic transducers without increasing the manufacturing cost of the transducers. The specific transducer structure in which the inventive process was successfully applied employs a square bi-laminar polarized ceramic plate flexibly mounted at its nodal points such as the transducer construction illustrated in FIGS. 1 to 4 of U.S. Pat. No. 3,937,991. Applicant's problem was to produce transducer assemblies which will operate at a specified frequency as efficient transmitters, for which use the resonant frequency of the square transducer elements must be adjused so that the minimum motional impedance ($Z_{min}$) of the elements occurs at the specified operating frequency. Transducer assemblies were also required to operate at the same specified operating frequency as efficient receivers, for which case the anti-resonant frequency of square transducer elements must be adjusted so that the maximum motional impedance ($Z_{max}$) of the elements occurs at the same specified operating frequency.

The inventive procedure developed by Applicant to achieve the desired objectives is to prepare an entire production lot of square ceramic elements to have the same width dimension which is somewhat larger than the final maximum width dimension required by any element in the lot to meet the motional impedance vs frequency requirements that will make $Z_{min}$ and $Z_{max}$ occur at the specified operating frequency. The oversized uniform width dimensioned ceramic elements, illustrated as 2 in the drawings, are placed in the cartridge 1, and after each element is ejected by the shuttle plate 3, the frequency at which $Z_{min}$ and $Z_{max}$ occurs is automatically measured by the schematic circuit described above. Each measured ceramic is automatically dropped into an automatically presented storage box 15 which is specifically assigned to the particular measured frequency deviation of the ceramic motional impedance from the specified operating frequency desired for elements. The ceramics in each of the different storage boxes are then machined as separate lots to reduce the width dimensions of the square plates in each lot by a different specified amount sufficient to raise the resonant or anti-resonant frequency of the ceramic elements in the lot to meet the specified values necessary to satisfy the operating requirements of the transducers.

By adjusting the resonant frequency (fR) of the separate groups of elements by grinding the width dimensions of the different segregated groups of ceramic plates by the required amounts necessary to raise the resonant frequency of each group to the specified operating frequency of the transmitting transducer, the adjusted elements will all have their minimum motional impedance ($Z_{min}$) at the specified operating frequency. These elements will then become efficient transmitting transducers which can be driven at low voltage to produce maximum acoustic output because of the inventive minimum impedance adjustment procedure carried out for the segregated groups of transducer elements. Similarly, by adjusting the anti-resonant frequency (fA) of other segregated groups of elements to the same specified operating frequency of the system, the adjusted elements will all have their maximum motional impedance ($Z_{max}$) at the specified operating frequency, and thus will become efficient receiving units which will have maximum receiving sensitivity at the specified operating frequency. Thus the inventive process has been successfully applied by Applicant to achieve the objects of the invention.

The logic circuit illustrated in FIG. 1 can be easily programmed by any one skilled in computer electronics to automatically segregate the ceramics into two lots; one lot of boxes will receive the vibratile elements which have been automatically tested and segregated for $Z_{min}$ vs frequency. The second lot of boxes will receive the vibratile elements which have been automatically tested and segregated for $Z_{max}$ vs frequency. The two segregated groups of elements are then processed in accordance with the above-described procedure to produce two groups of finished transducer elements, one group having minimum motional impedance ($Z_{min}$), and the other group having maximum motional impedance ($Z_{max}$) at the same specified operating frequency. The low-impedance elements are then employed as transmitting transducers, and the high-impedance elements are employed as receiving transducers. As a result of the described selective procedure, the system acoustic response is optimized by using a low-impedance selected element as the transmitter and a high-impedance selected element as the receiver. The use of such matched pairs of transducers will eliminate the necessity for the use of tuning chokes which are typically required for prior art transducers which have not been possible of economic selection in matched pairs of resonant and anti-resonant frequency, as is easily accomplished by the inventive procedure herein disclosed.

The application of the disclosed method for automatically measuring and economically adjusting the resonant and anti-resonant frequencies of large groups of transducer elements has resulted in improved system response at greatly reduced cost. It has also made it possible to eliminate the need for tuning chokes as are generally necessary in prior art systems for achieving broad band response for the transducers built by prior art procedures without benefit of the inventive selection and frequency adjustment process herein disclosed.

Although a specific example has been described to illustrate one successful large-scale commercial application of the invention, it should be noted that various additional modifications and alternatives may be made in the disclosed process without departing from the true spirit and scope of the invention. Therefore, the appended claims are intended to cover all such equivalent alternatives that fall within their true spirit and scope.

I claim:

1. A method for manufacturing electroacoustic transducers which incorporate in their design vibratile transducer elements which are required to operate within a specified frequency band in the vicinity of the resonant frequency region of said elements, including the following steps:

(a) adjust at least one of the resonant frequency controlling dimensions of a plurality of transducer elements to a uniform specified value which is greater than the dimension necessary to achieve the specified resonant frequency for said plurality of transducer elements, (b) measure the motional impedance of each transducer element as a function of frequency over a frequency range which includes the resonant frequency region of the transducer element, (c) determine the frequency at which the motional impedance of each transducer element is a minimum, (d) segregate the transducer elements into separate groups in which each particular segregated group contains selected elements whose minimum motional impedance lies within a particular specified narrow frequency band assigned to the particular segregated group, (e) reduce the resonant frequency controlling dimension of the transducer elements within each particular segregated group by a prescribed specified amount to cause the frequency at which the minimum motional impedance occurs to change by the required amount needed to make the resonance frequency characteristics of all elements contained within each segregated group fall within the same specified operating frequency band.

2. The invention in claim 1 characterized in that steps (b), (c), and (d) are automated.

3. The invention in claim 1 characterized in that said vibratile transducer element is a bi-laminar plate and further characterized in that the controlling dimension for the resonant frequency is the width of said bi-laminar plate.

4. The invention in claim 3 characterized in that said bi-laminar plate is a circular disc.

5. The invention in claim 3 further characterized in that said bi-laminar plate is square.

6. The invention in claim 5 further characterized in that the adjusted uniform specified dimensions of said plurality of bi-laminar square plates are the width dimensions of said bi-laminar square plates.

7. The invention in claim 6 further characterized in that the specified reduction in the frequency controlling dimension for each different segregated group of elements is a specified reduction in the width dimensions of said square bi-laminar plates.

8. A method for manufacturing electroacoustic transducers which incorporate in their design vibratile transducer elements which are required to operate within a specified frequency band in the vicinity of the anti-resonant frequency region of said elements, including the following steps:

(a) adjust at least one of the anti-resonant frequency controlling dimensions of a plurality of transducer elements to a uniform specified value which is greater than the dimension necessary to achieve the specified anti-resonant frequency for said plurality of transducer elements, (b) measure the motional impedance of each transducer element as a function of frequency over a frequency range including the anti-resonant frequency region of the transducer element, (c) determine the frequency at which the motional impedance of each transducer element is a maximum, (d) segregate the transducer elements into separate groups in which each particular group contains selected elements whose maximum motional impedance lies within a particular specified narrow frequency band assigned for the particular group, (e) reduce the anti-resonant frequency controlling dimension of the transducer elements within each particular segregated group by a particular specified amount necessary to cause the frequency at which the maximum motional impedance occurs for each different segregated group of elements to fall within the same specified operating frequency band.

9. The invention in claim 8 characterized in that steps (b), (c), and (d) are automated.

10. The invention in claim 8 characterized in that said vibratile transducer element is a bi-laminar plate and further characterized in that the anti-resonant frequency controlling dimension is the width of said bi-laminar plate.

11. The invention in claim 10 characterized in that said bi-laminar plate is a circular disc.

12. The invention in claim 10 further characterized in that said bi-laminar plate is square.

13. The invention in claim 12 further characterized in that the adjusted uniform specified dimensions of said plurality of bi-laminar square plates are the width dimensions of said bi-laminar square plates.

14. The invention in claim 13 further characterized in that the specified reduction in the frequency controlling dimension for each different segregated group of elements is a specified reduction in the width dimensions of said square bi-laminar plates.

* * * * *